US009291415B1

(12) United States Patent
Beaty

(10) Patent No.: US 9,291,415 B1
(45) Date of Patent: Mar. 22, 2016

(54) ADJUSTABLE GAS KEY

(71) Applicant: David L. Beaty, Mesa, AZ (US)

(72) Inventor: David L. Beaty, Mesa, AZ (US)

( * ) Notice: Subject to any disclaimer, the term of this patent is extended or adjusted under 35 U.S.C. 154(b) by 117 days.

(21) Appl. No.: 13/969,167

(22) Filed: Aug. 16, 2013

(51) Int. Cl.
*F41A 5/28* (2006.01)

(52) U.S. Cl.
CPC ..... *F41A 5/28* (2013.01)

(58) Field of Classification Search
CPC ..... F41A 5/18; F41A 5/20; F41A 5/22; F41A 5/24; F41A 5/26; F41A 5/28
USPC ..... 89/193
See application file for complete search history.

(56) References Cited

U.S. PATENT DOCUMENTS 1,366,863 A * 1/1921 Berthier ..... F41A 3/32 89/193
3,968,727 A * 7/1976 Hyytinen ..... F41A 5/28 89/191.02
4,244,273 A * 1/1981 Langendorfer, Jr. ..... F41A 5/28 89/193
5,272,956 A * 12/1993 Hudson ..... F41A 5/28 42/72
8,371,209 B2 * 2/2013 Boutin, Jr. ..... F41A 5/24 89/179
2005/0223613 A1 * 10/2005 Bender ..... F41A 5/24 42/16
2014/0076143 A1 * 3/2014 Hall ..... F41A 19/03 89/129.01
2014/0083286 A1 * 3/2014 Gomez ..... F41A 5/28 89/193
2014/0318361 A1 * 10/2014 Larue ..... F41A 5/24 89/193

* cited by examiner

*Primary Examiner* — Troy Chambers
*Assistant Examiner* — Bridget Cochran
(74) *Attorney, Agent, or Firm* — Schmeiser, Olsen & Watts LLP

(57) ABSTRACT

An adjustable gas key for use with a firearm is provided. The adjustable gas key includes a base portion and a tube portion coupled to the base portion. An inlet tube extends through the tube portion and an outlet tube angled from the inlet tube exits through a bottom side of the base portion. The adjustable gas key includes an inner volume located at a junction of the inlet tube and the outlet tube. The adjustable gas key also includes an adjustment device operatively coupled to the adjustable gas key, wherein the adjustment device adjusts a size of the inner volume. The adjustable gas key is operatively coupled to a bolt carrier of the firearm, wherein adjustment of the size of the inner volume adjusts the force of action of the bolt carrier.

13 Claims, 3 Drawing Sheets

ADJUSTABLE GAS KEY

BACKGROUND OF THE INVENTION

1. Technical Field

This invention relates generally to a gas key and more particularly to an adjustable gas key for use with a bolt carrier of a firearm.

2. State of the Art

Particular firearms, such as an AR15, utilize a gas-operation system. A gas-operation system is a system of operation used to provide energy to operate auto loading firearms. In gas-operation, a portion of high pressure gas from the cartridge being fired is used to power a mechanism to extract the spent case and chamber a new cartridge. Energy from the gas is harnessed through either a port in the barrel or trap at the muzzle. This high-pressure gas impinges on a surface such as a piston head to provide motion for unlocking of the action, extraction of the spent case, ejection, cocking of the hammer or striker, chambering of a fresh cartridge, and locking of the action.

Conventional systems do not provide a mode of adjusting the force of the gas-operation system, or the blow back force when the firearm is fired. Accordingly, there is a need for a system to adjust the force of the gas-operation system.

DISCLOSURE OF THE INVENTION

The present invention relates to a gas key and more particularly to an adjustable gas key for use with a bolt carrier of a firearm.

An embodiment includes an adjustable gas key for use with a firearm. The adjustable gas key includes a base portion and a tube portion coupled to the base portion, wherein an inlet tube extending through the tube portion and an outlet tube angled from the inlet tube, wherein the outlet tube exits through a bottom side of the base portion. The adjustable gas key further includes an inner volume located at a junction of the inlet tube and the outlet tube. Additionally, the adjustable gas key includes an adjustment device operatively coupled to the adjustable gas key, wherein the adjustment device adjusts a size of the inner volume.

Another embodiment includes a firearm with an adjustable gas key. The firearm includes a firearm utilizing a gas-operated system, the firearm comprising an upper receiver, a lower receiver and a gas tube extending from a gas block coupled to the barrel to a bolt carrier. The firearm also includes an adjustable gas key coupled to the bolt carrier. The adjustable gas key includes a base portion; a tube portion coupled to the base portion, the tube portion engaging the gas tube, wherein an inlet tube extending through the tube portion and an outlet tube angled from the inlet tube, wherein the outlet tube exits through a bottom side of the base portion, such that propellant gas produced by firing the firearm is directed through the gas tube and through the inlet tube and exits through the outlet tube; an inner volume located at a junction of the inlet tube and the outlet tube; and an adjustment device operatively coupled to the adjustable gas key, wherein the adjustment device adjusts a size of the inner volume.

Another embodiment includes a method of using an adjustable gas key. The method includes the steps of coupling an adjustable gas key to a bolt carrier and operatively coupling the bolt carrier between an upper receiver and lower receiver of a firearm; adjusting an adjustable device of the adjustable gas key, wherein a size of an inner volume of the adjustable gas key is adjusted in response to adjusting the adjustable device; testing operation of the firearm to determine correct firing and discharge of the expended shell; and partially disengaging the upper receiver from the lower receiver to adjust the adjustment device in response to an improper firing or discharge of the expended shell of the firearm.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, the Figures are not necessarily drawn to scale, and:

DETAILED DESCRIPTION OF EMBODIMENTS OF THE INVENTION

Gas-operated firearms have various types of ammunition that can be utilized by the firearm and further ammunition is produced by various manufacturers. This ammunition by different manufacturers results in varied amounts of gas that runs from a gas block to the gas key in order to operate the bolt carrier of the firearm. Further, other causes of varied amounts of gas that runs from the gas block to the gas key include the use of suppressors, which create more back pressure and the manufacturing of a gas port that is too big. Additionally, gas may be varied because of worn parts, such as gas rings, as well as leaks in the gas system, such as between the gas key and the bolt carrier and the between the gas block and the gas tube. Because of the varied amounts of gas, there is a need to adjust the system in order for the firearm to operate correctly.

Existing systems try to adjust the gas flowing to the gas key by using adjustable gas blocks or by adjusting the dimensions of the gas tube. These systems are time consuming and difficult to adjust because it requires the dismantling of the firearm to expose the adjustable feature of the gas block, and further are not applicable to every firearm. Accordingly, a new and improved means of adjusting the gas is needed.

As discussed above, embodiments of the present invention relate to an adjustable gas key for use with a bolt carrier of a firearm. Specifically, the adjustable gas key can be utilized to replace a conventional existing gas key and operate the firearm properly. Embodiments of the adjustable gas key are particularly useful in systems that utilize a direct impingement method of operation that vents gas through a tube to the working parts of a rifle where they directly impinge on the bolt carrier. In direct impingement systems, the propellant gas produced by firing a round is blown directly into the action parts and engages the gas key to recoil the bolt carrier. As discussed previously, the type of ammunition and manufacturer, use of suppressors and gas port placement and size can result in varying amounts of propellant gas that moves through the gas tube to the gas key and can easily result in unreliable operation of the firearm, including a short stroke or other issues that affect whether the expired shell is properly ejected from the firearm.

Figure 1:
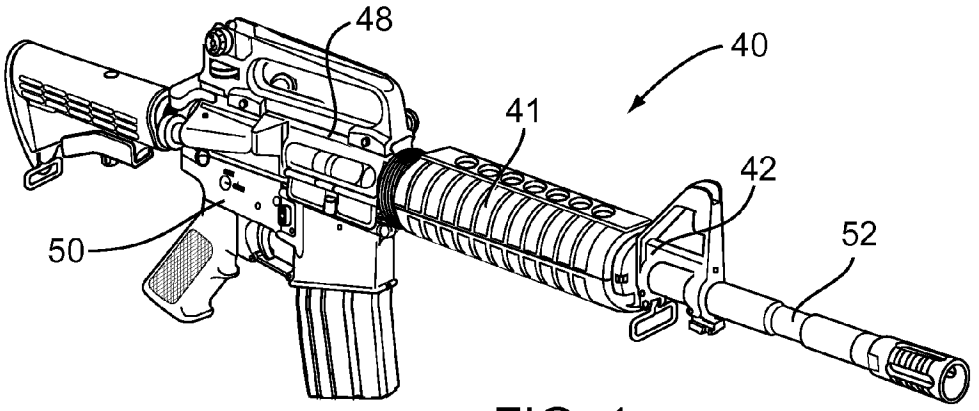
FIG. 1 is a perspective view of a firearm having a gas-operated system.
Figure 2:
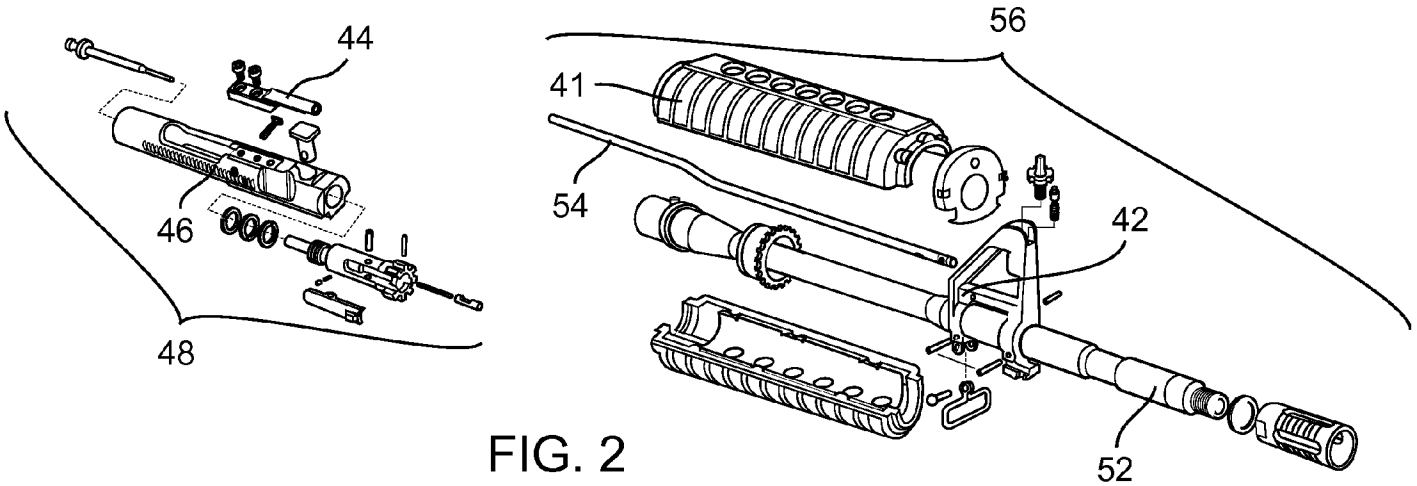
FIG. 2 is a perspective exploded view of a bolt carrier, a conventional gas key, and a barrel/hand guard assembly.
Figure 3:
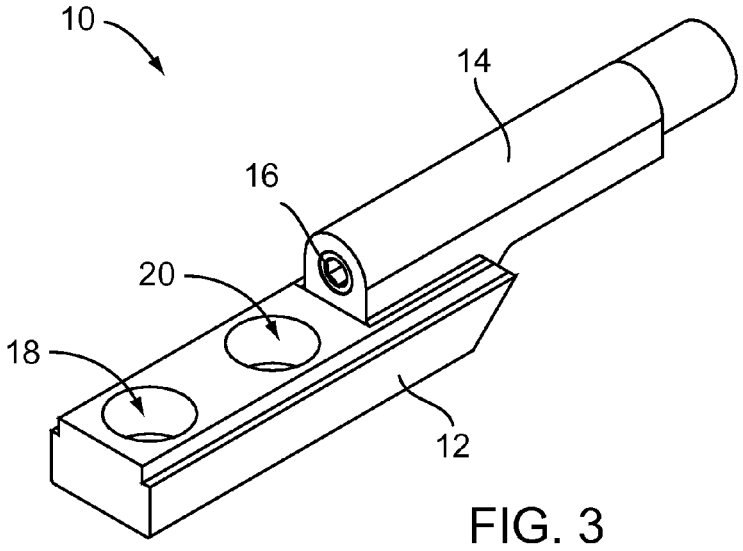
FIG. 3 is a perspective view of an adjustable gas key.
Figure 4:
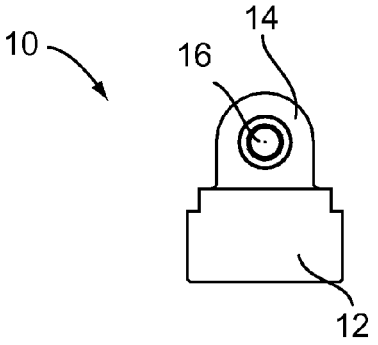
FIG. 4 is back view of an adjustable gas key.
Figure 5:
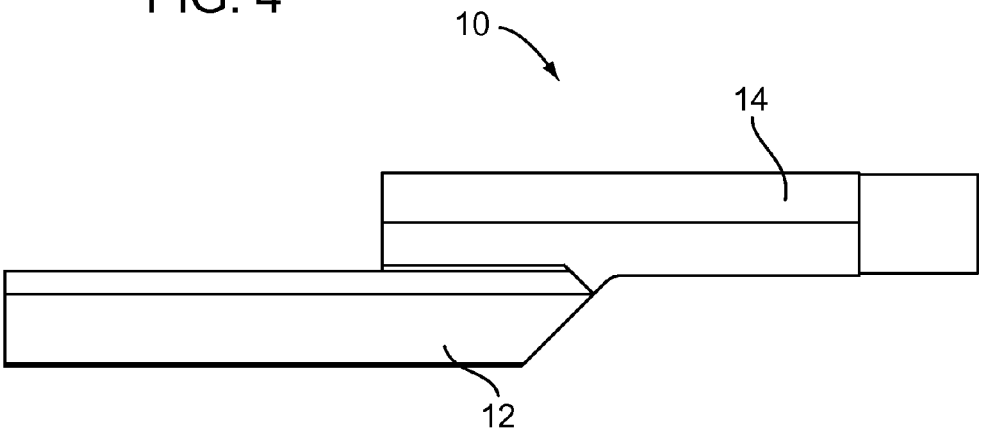
FIG. 5 is a side view of an adjustable gas key.
Figure 6:
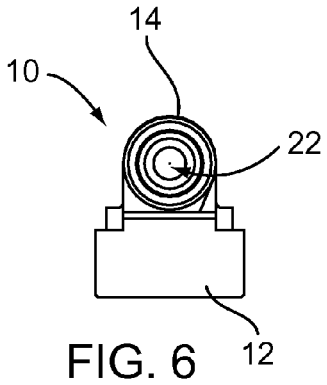
FIG. 6 is front view of an adjustable gas key.
Figure 7:
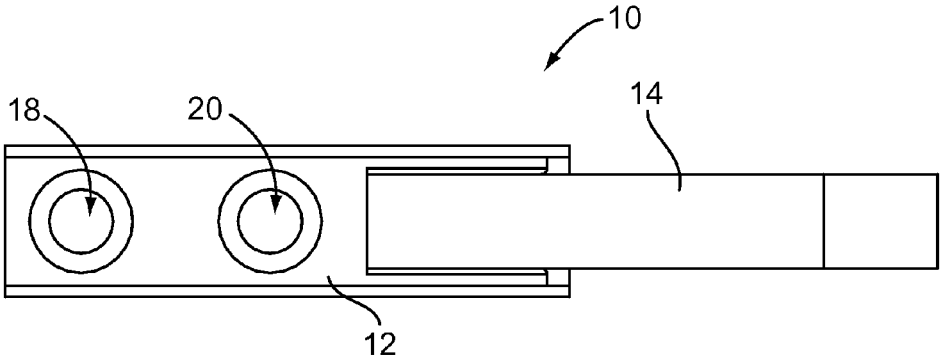
FIG. 7 is a top view of an adjustable gas key.
Figure 8:
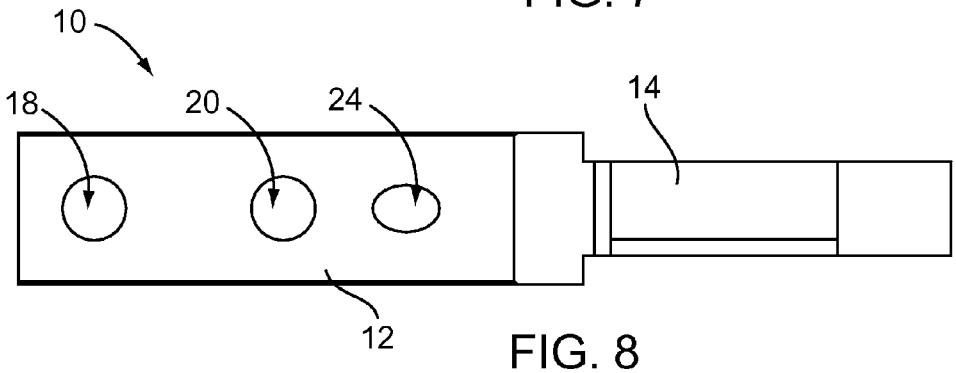
FIG. 8 is a bottom view of an adjustable gas key.

Referring to FIGS. 1 and 2, a firearm 40 is shown wherein embodiments of the present invention can be used within. Generally speaking, among many components, a firearm 40 includes and upper receiver 48; a lower receiver 50; barrel/hand guard assembly 56 having a gas block 42, a gas tube 54 and a barrel 52; and a bolt carrier assembly 48 having a bolt carrier 46 and a gas key 44. The gas tube 54 engages a gas key 44 that may be coupled directly to the bolt carrier 46 in order for the firearm to operate correctly. It is understood that while a FIGS. 1 and 2 depict a firearm 40 with a gas block 42 that also serves as a site tower, other gas blocks 42 are common that do not include a site tower. Further, often times the hand guard 41 encloses the gas block 42, wherein the gas block is not accessible unless the hand guard 41 is removed from the firearm 40.

Referring again to the drawings, FIGS. 3-9 depict an adjustable gas key 10, wherein according to embodiments of the present invention adjustable gas key 10 replace gas key 44 depicted in FIG. 2. Adjustable gas key 10 includes a base portion 12 having apertures 18 and 20, wherein apertures 18 and 20 correspond to holes in the bolt carrier 46. Fastening devices, such as screws, may engage the holes in the bolt carrier while extending through the holes. These fastening devices removably couple the adjustable gas key 10 to the bolt carrier. The adjustable gas key 10 further includes a tube portion 14. The tube portion 14 engages a gas tube that extends from the gas block to the bolt carrier.

The adjustable gas key 10 further includes an adjustment device 16. In some embodiments the adjustment device 16 includes, but is not limited to an adjustment screw, a valve, such as a ball valve, or the like. The turning of the adjustment screw in one direction or the other results in the adjustment of the amount of gas that flows through the adjustable gas key 10.

Figure 9:
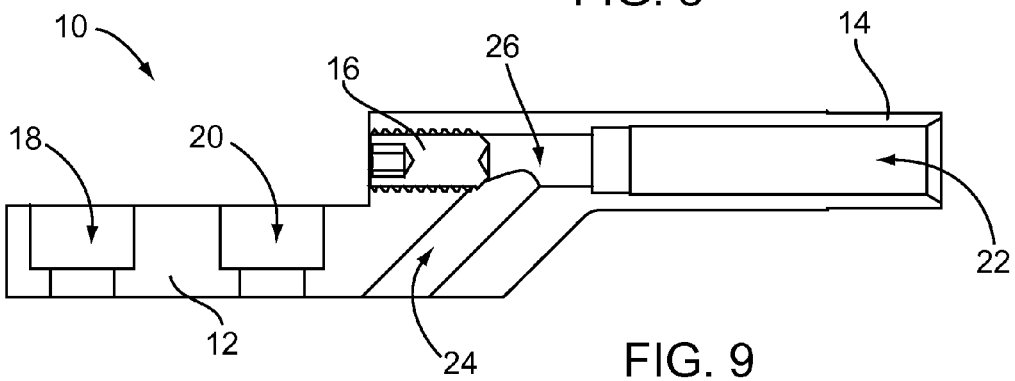
FIG. 9 is a section view of an adjustable gas key.

Referring specifically to FIG. 9 depicts an inner tube having an inlet tube 22 extending through the tube portion 14 to outlet tube 24 extending at an angle from the inlet tube 22 to exit through a bottom side of the base portion. The inlet tube 22 connected to the outlet tube 24 forms an inner volume section 26. The adjustment device 16 engages the inner volume 26, wherein the rotation of the adjustment device 16 moves the adjustment device 16 into and out of the inner volume 26. This movement of the adjustment device 16 into and out of the inner volume 26 adjusts the size of the inner volume 26, which thereby adjusts the force produced by propellant gas that impinges the bolt carrier through the adjustable gas key 10. Adjusting the adjustable gas key 10 provides the ability to properly adjust the recoil of the bolt carrier to avoid cartridge or shell extractions and ejection issues and to better account for variations in the ammunition provided by a various manufacturers and other causes of variations in the production of the propellant gas.

As shown in the drawing figures, the adjustment device 16 may be aligned with the inner tube 22. However, it will be understood that the adjustment device 16 may extend at any angle from the adjustable gas key 10 so long as the adjustment device 16 engages inner volume 26 at any point along the inlet or outlet tube 22 and 24.

Locating the adjustment device 16 on the adjustable gas key 10 allows for a user to easily adjust the adjustment device 16. The bolt carrier is coupled between the upper and lower receivers 48 and 50 of a firearm. Therefore, utilizing a common two pin connection between the upper and lower receivers 48 and 50 of the firearm 40, a user can disengage a rear pin to allow access to the gas key 10 and adjust the adjustment device 16 and then engage the rear pin and fire the firearm.

Another embodiment of the present invention includes a method of using an adjustable gas key. The method includes the steps of coupling an adjustable gas key to a bolt carrier and operatively coupling the bolt carrier between an upper receiver and lower receiver of a firearm; adjusting an adjustable device of the adjustable gas key, wherein a size of an inner volume of the adjustable gas key is adjusted in response to adjusting the adjustable device; testing operation of the firearm to determine correct extraction and discharge of the expended shell; and partially disengaging the upper receiver from the lower receiver to adjust the adjustment device in response to an improper firing or discharge of the expended shell of the firearm.

In the method the adjusting the adjustment device comprises rotating the adjustment device. Further, in some embodiments, the adjustment device is an adjustment screw. Additionally, the adjusting the adjustment device comprises moving the adjustment device into and out of the inner volume.

The method further comprises adjusting the force of the recoil of the bolt carrier in response to the adjusting the adjustment device; and reengaging the upper receiver with the lower receiver after adjusting the adjustment device. The method may also include repeating the adjustment of the adjusting device until a proper ejection pattern of expired shells from the firearm is obtained.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. An adjustable gas key for use with a firearm, the adjustable gas key comprising:

a base portion;

a tube portion coupled to the base portion, wherein an inlet tube extending through the tube portion and an outlet tube angled from the inlet tube, wherein the outlet tube exits through a bottom side of the base portion;

an inner volume located at a junction of the inlet tube and the outlet tube; and an adjustment device coupled directly to the adjustable gas key, wherein the adjustment device adjusts a size of the inner volume of the junction of the inlet tube and the outlet tube.

2. The adjustable gas key of claim 1, wherein the adjustment device is rotatably coupled to the adjustable gas key, wherein the size of the inner volume is adjusted in response to rotation of the adjustment device.

3. The adjustable gas key of claim 2, wherein the adjustment device is an adjustment screw.

4. The adjustable gas key of claim 2, wherein the adjustment device is a valve.

5. The adjustable gas key of claim 1, wherein the adjustment device is aligned with the inlet tube.

6. The adjustable gas key of claim 1, further comprising a bolt carrier, wherein the adjustable gas key is coupled to the bolt carrier.

7. A firearm with an adjustable gas key comprising:

a firearm utilizing a gas-operated system, the firearm comprising an upper receiver, a lower receiver and a gas tube extending from a gas block coupled to the barrel to a bolt carrier; and an adjustable gas key coupled to the bolt carrier, the adjustable gas key comprising:

a base portion;

a tube portion coupled to the base portion, the tube portion engaging the gas tube, wherein an inlet tube extending through the tube portion and an outlet tube angled from the inlet tube, wherein the outlet tube exits through a bottom side of the base portion, such that propellant gas produced by firing the firearm is directed through the gas tube and through the inlet tube and exits through the outlet tube;

an inner volume located at a junction of the inlet tube and the outlet tube; and an adjustment device rotatable coupled directly to the adjustable gas key, wherein the adjustment device adjusts a size of the inner volume of the junction of the inlet tube and the outlet tube to adjust a force of action of the bolt carrier.

8. The firearm of claim 7, wherein the adjustment device is rotatably coupled to the adjustable gas key, wherein the size of the inner volume is adjusted in response to rotation of the adjustment device.

9. The firearm of claim 8, wherein the adjustment device is an adjustment screw.

10. The firearm of claim 8, wherein the adjustment device is a valve.

11. The firearm of claim 7, wherein the adjustment device is aligned with the inlet tube.

12. The firearm of claim 7, wherein bolt carrier is operatively coupled between the upper receiver and the lower receiver.

13. The firearm of claim 12, wherein adjustment device of the adjustable gas key is operable when the upper receiver is partially disengaged from the lower receiver.

* * * * *

UNITED STATES PATENT AND TRADEMARK OFFICE

CERTIFICATE OF CORRECTION

PATENT NO. : 9,291,415 B1
APPLICATION NO. : 13/969167
DATED : March 22, 2016
INVENTOR(S) : David L. Beaty It is certified that error appears in the above-identified patent and that said Letters Patent is hereby corrected as shown below:

Claims

In claim 7, Column 5, Line 19, the word "rotatable" should read "rotatably."

Signed and Sealed this
Twenty-fourth Day of May, 2016

Michelle K. Lee

Michelle K. Lee
*Director of the United States Patent and Trademark Office*